US007758400B2

(12) United States Patent
Moomaw

(10) Patent No.: US 7,758,400 B2
(45) Date of Patent: Jul. 20, 2010

(54) VISUAL DISPLAY

(75) Inventor: David E. Moomaw, East Aurora, NY (US)

(73) Assignee: Bergman Design Corporation, Mountain Lakes, NJ (US)

( * ) Notice: Subject to any disclaimer, the term of this patent is extended or adjusted under 35 U.S.C. 154(b) by 391 days.

(21) Appl. No.: 11/508,848

(22) Filed: Aug. 24, 2006

(65) Prior Publication Data

US 2007/0026761 A1 Feb. 1, 2007

Related U.S. Application Data

(62) Division of application No. 10/841,696, filed on May 6, 2004, now Pat. No. 7,311,580.

(51) Int. Cl.
*A63H 3/06* (2006.01)

(52) U.S. Cl. ..... 446/179; 446/176; 446/220; 40/414; 40/412

(58) Field of Classification Search ..... 446/220, 446/221, 226, 176, 179; 40/406, 410, 414, 40/412

See application file for complete search history.

(56) References Cited

U.S. PATENT DOCUMENTS

| | | | |
|---|---|---|---|
| 2,543,606 | A | 2/1951 | Solomon et al. |
| 2,621,042 | A | 12/1952 | Stein et al. |
| 2,643,598 | A | 6/1953 | Carroll |
| 2,748,256 | A | 5/1956 | Moran |
| 3,066,439 | A | 12/1962 | Lemelson |
| 3,363,350 | A | 1/1968 | Moran |
| 3,670,440 | A | 6/1972 | Yost |
| 3,672,083 | A | 6/1972 | Moran |
| 3,745,677 | A | 7/1973 | Moran |
| 3,835,308 | A | 9/1974 | Reese |
| 3,905,140 | A | 9/1975 | Damiano |
| 3,999,750 | A | 12/1976 | Perkins |
| 4,028,830 | A | 6/1977 | Ottinger |
| 4,076,234 | A | 2/1978 | Bumbaum |

(Continued)

FOREIGN PATENT DOCUMENTS

| | | |
|---|---|---|
| DE | 202 17 692 U1 | 2/2003 |

(Continued)

OTHER PUBLICATIONS

International Search Report for PCT/US2005/015892 (publ. No. PCT WO 2005/107422), completed on Dec. 1, 2005.

*Primary Examiner*—Gene Kim
*Assistant Examiner*—Urszula M Cegielnik
(74) *Attorney, Agent, or Firm*—Venable LLP

(57) ABSTRACT

Outer and inner inflatable members and a motor assembly including a fan are disposed on a base member. Air provided under pressure by the motor assembly including the fan passes through vents in the base member to inflate the inflatable members. Flakes are disposed in the space between the inflatable members. One vent, larger than the others, provides for the flakes to be lifted upwardly from the base member by the pressurized air. At least another vent in the base member provides for a movement of the flakes by the pressurized air in an annular direction in the space between the inflatable members. A permeable cap disposed on the outer inflatable member limits the pressure in the outer and inner inflatable members to a particular value.

8 Claims, 4 Drawing Sheets

U.S. PATENT DOCUMENTS 4,179,832 A * 12/1979 Lemelson ..... 40/540
4,190,312 A 2/1980 Bailey
4,205,811 A 6/1980 Palm et al.
4,271,620 A * 6/1981 Vicino et al. ..... 40/406
4,306,668 A 12/1981 Love
4,641,445 A 2/1987 Rossi
4,776,121 A 10/1988 Viccino
4,817,311 A 4/1989 Ong
4,861,215 A 8/1989 Bonerb
4,932,169 A 6/1990 Charbonneau
4,962,922 A 10/1990 Chu
4,995,186 A 2/1991 Collie
5,092,065 A 3/1992 Teng
5,098,084 A 3/1992 Culver
5,110,636 A 5/1992 Hou
5,125,177 A 6/1992 Colting
5,131,175 A 7/1992 Liu
5,200,239 A 4/1993 Chen
5,215,492 A 6/1993 Kubiatowicz
5,291,674 A 3/1994 Torrence
5,313,727 A 5/1994 Murray
5,412,888 A 5/1995 Rickuss et al.
5,442,869 A 8/1995 McDarren et al.
5,451,179 A 9/1995 LaRoi, Jr. et al.
5,467,543 A 11/1995 Fink et al.
5,471,797 A 12/1995 Murphy
5,491,916 A 2/1996 Ingram et al.
5,502,908 A 4/1996 Powell et al.
5,632,419 A 5/1997 Pickens
5,666,750 A 9/1997 Segan et al.
5,705,759 A 1/1998 De Vivo
5,710,543 A 1/1998 Moore
5,711,099 A 1/1998 Nesbit et al.
5,778,581 A 7/1998 Bailey
5,816,884 A 10/1998 Chang
5,857,277 A 1/1999 Mayze
5,864,976 A 2/1999 Yang
5,979,091 A 11/1999 Tenbrink
6,008,938 A 12/1999 Suehle et al.
6,012,826 A 1/2000 Chabert
6,048,591 A 4/2000 Zwiebel
6,052,930 A 4/2000 Hermanson et al.
6,141,941 A * 11/2000 Carroll ..... 53/434
6,145,227 A 11/2000 Liao
6,155,837 A 12/2000 Korneliussen
6,161,317 A 12/2000 Wang
6,186,857 B1 2/2001 Gazit et al.
6,276,815 B1 8/2001 Wu
6,279,254 B1 8/2001 Gill et al.
6,322,230 B1 11/2001 Medici
6,345,457 B1 2/2002 Bradley
6,357,151 B1 3/2002 Yuen
6,364,737 B1 4/2002 Sterr et al.
6,385,880 B1 5/2002 Naragon
6,415,535 B1 7/2002 White et al.
6,431,729 B1 8/2002 Chen
6,461,087 B2 * 10/2002 Lin ..... 406/106
6,550,169 B1 4/2003 Sena et al.
6,564,483 B1 5/2003 Hsu
6,568,107 B2 5/2003 Yuen
6,572,247 B2 6/2003 Liu
6,588,130 B1 7/2003 Yang
6,591,525 B1 7/2003 Liu
6,644,843 B2 11/2003 Chin-Cheng
6,675,513 B2 1/2004 Liao
6,696,116 B2 2/2004 Bigman
6,722,064 B2 4/2004 Knapp et al.
6,764,201 B2 7/2004 Chi-Cheng
7,040,050 B2 5/2006 Skinner
2001/0002354 A1 5/2001 Gazit et al.
2002/0000055 A1 1/2002 Augsburger
2002/0095831 A1 7/2002 Tsai
2002/0174578 A1 11/2002 Ross
2003/0041490 A1 3/2003 Dott et al.
2003/0177677 A1 9/2003 Acosta, Sr.
2004/0045198 A1 3/2004 Liu
2004/0244243 A1 12/2004 Tien
2005/0190556 A1 9/2005 Machala
2006/0107564 A1 5/2006 Machala
2006/0111011 A1 5/2006 Wang

FOREIGN PATENT DOCUMENTS

DE 203 17 200 U1 2/2004
JP 11/147400 A 6/1999

* cited by examiner

FIG. 2
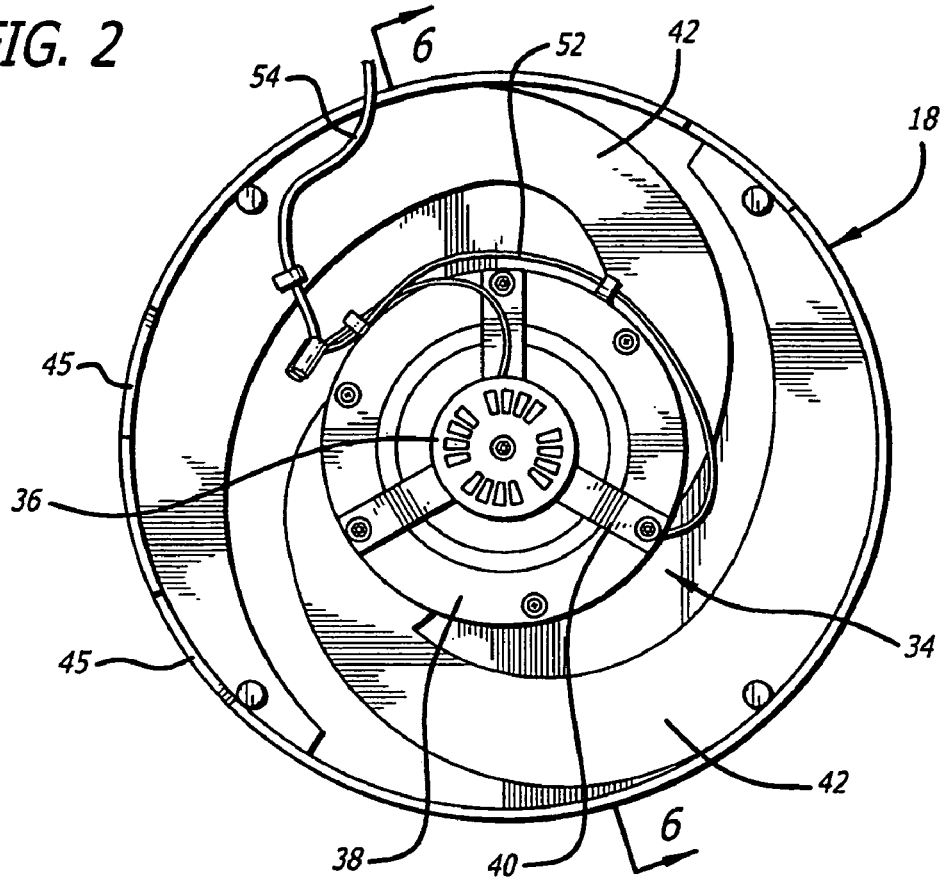
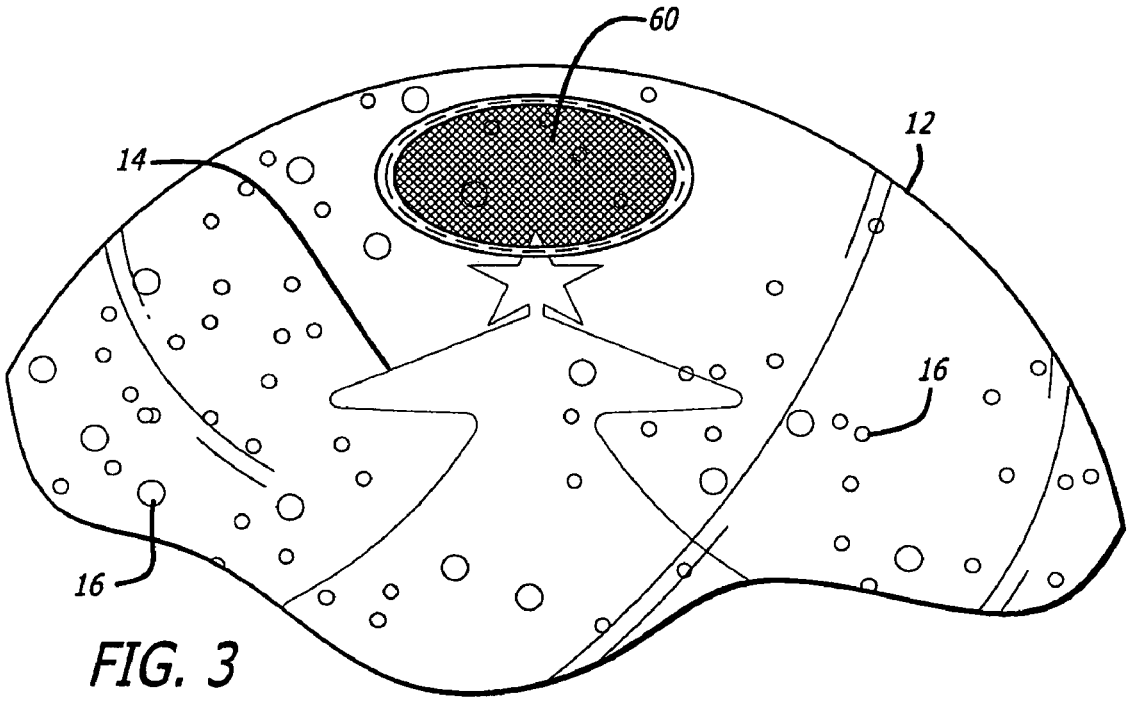
FIG. 3

VISUAL DISPLAY

This application is a divisional of U.S. patent application Ser. No. 10/841,696 filed May 6, 2004, now U.S. Pat. No. 7,311,580, issued Dec. 25, 2007, the entirety of which is incorporated herein by reference.

This invention relates to visual displays and more particularly to visual displays, and methods of providing visual displays, which are particularly adapted to be used for seasonal displays such as for Christmas. More particularly, this invention relates to visual displays which include an outer inflatable member, an inner inflatable member and flakes movable in an annular direction in the space between the inner and outer inflatable members.

BACKGROUND OF A PREFERRED EMBODIMENT OF THE INVENTION

Visual displays are provided on a seasonal basis to celebrate the season. For example, visual displays may be disposed in a family home during the Christmas season to enhance the appearance of the season in the home and to celebrate the season. Although popular, the visual displays now in use have a limited appeal. It would be desirable to provide a visual display which has an advanced aesthetic and sophistication and which represents a particular season (e.g., Christmas) on a more fulfilling basis than the visual displays of the prior art.

BRIEF DESCRIPTION OF A PREFERRED EMBODIMENT OF THE INVENTION

Outer and inner inflatable members and a motor assembly including a fan are disposed on a base member. Air provided under pressure by the motor assembly including the fan passes through vents in the base member to inflate the inflatable members. Flakes are disposed in the space between the inflatable members. One vent, larger than the others, provides for the flakes to be lifted upwardly from the base member by the pressurized air. At least another vent in the base member provides for a movement of the flakes by the pressurized air in an annular direction in the space between the inflatable members. A permeable cap disposed on the outer inflatable member limits the pressure in the inflatable members to a particular value.

BRIEF DESCRIPTION OF THE DRAWINGS

In the drawings:

FIG. 2 is a bottom plan view of the visual display shown in FIG. 1;

FIG. 3 is an enlarged fragmentary perspective view of the top of the visual display;

DETAILED DESCRIPTION OF A PREFERRED EMBODIMENT OF THE INVENTION

Figure 1:
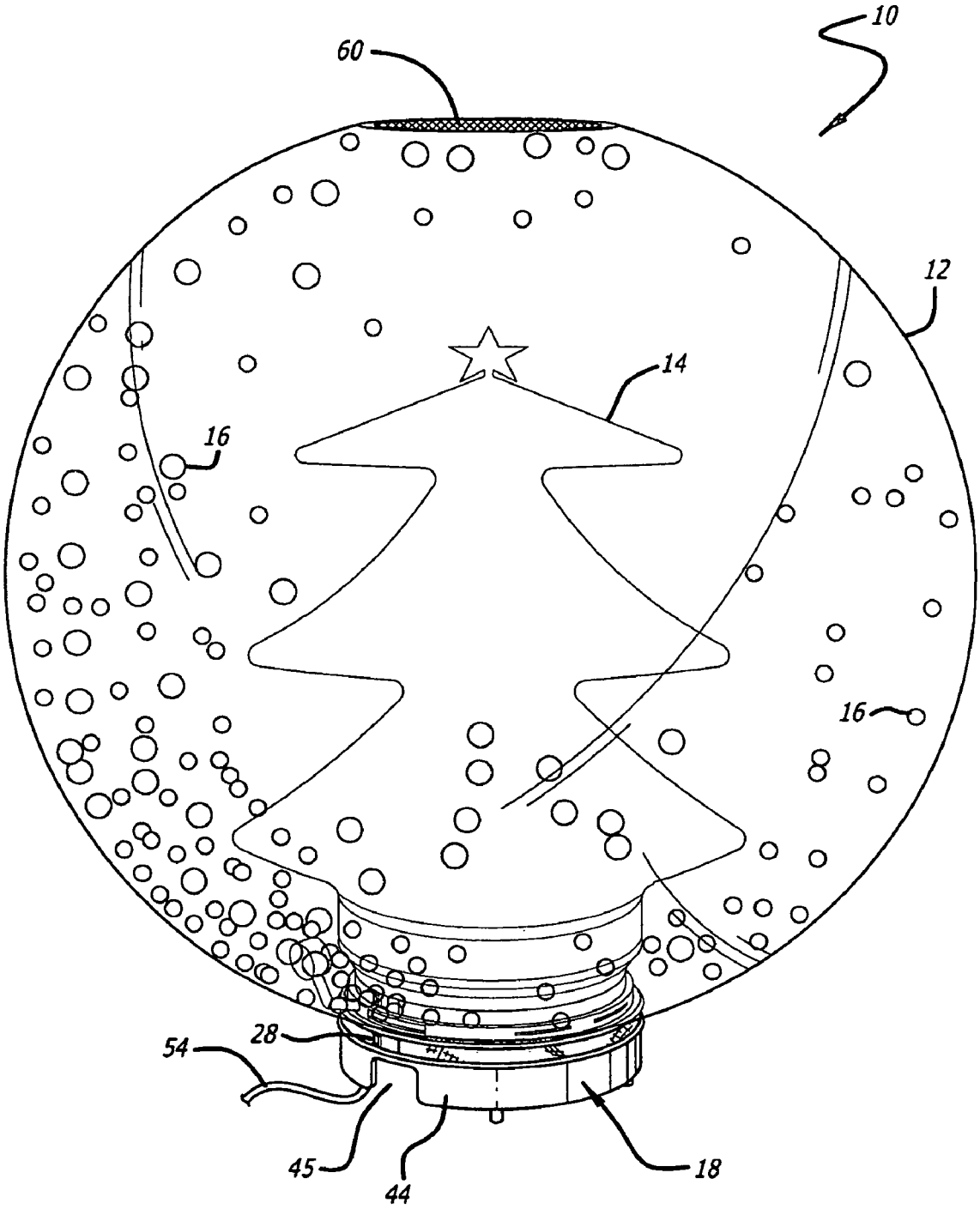
FIG. 1 is a schematic front elevational perspective view of a visual display constituting a preferred embodiment of the invention.

A visual display generally indicated at 10 is shown in the drawings. The visual display 10 may be seasonal. For example, the visual display shown in the drawings includes an outer inflatable member 12 in the form of a globe and an inner inflatable member 14 in the form of a tree which may be considered to be a Christmas tree. The tree is disposed within the globe 12.

Flakes 16 are disposed in the space between the outer inflatable member 12 and the inner inflatable member 14. The flakes 16 may be preferably white to convey the appearance of snowflakes and are preferably light in weight and made from a suitable plastic material. It will be appreciated that the visual appearances of the outer inflatable member 12 and the inner inflatable member 14 are only illustrative and that the inflatable members 12 and 14 may have a vast number of different shapes or configurations. The inflatable members 12 and 14 may be made from an impermeable plastic material.

Figure 6:
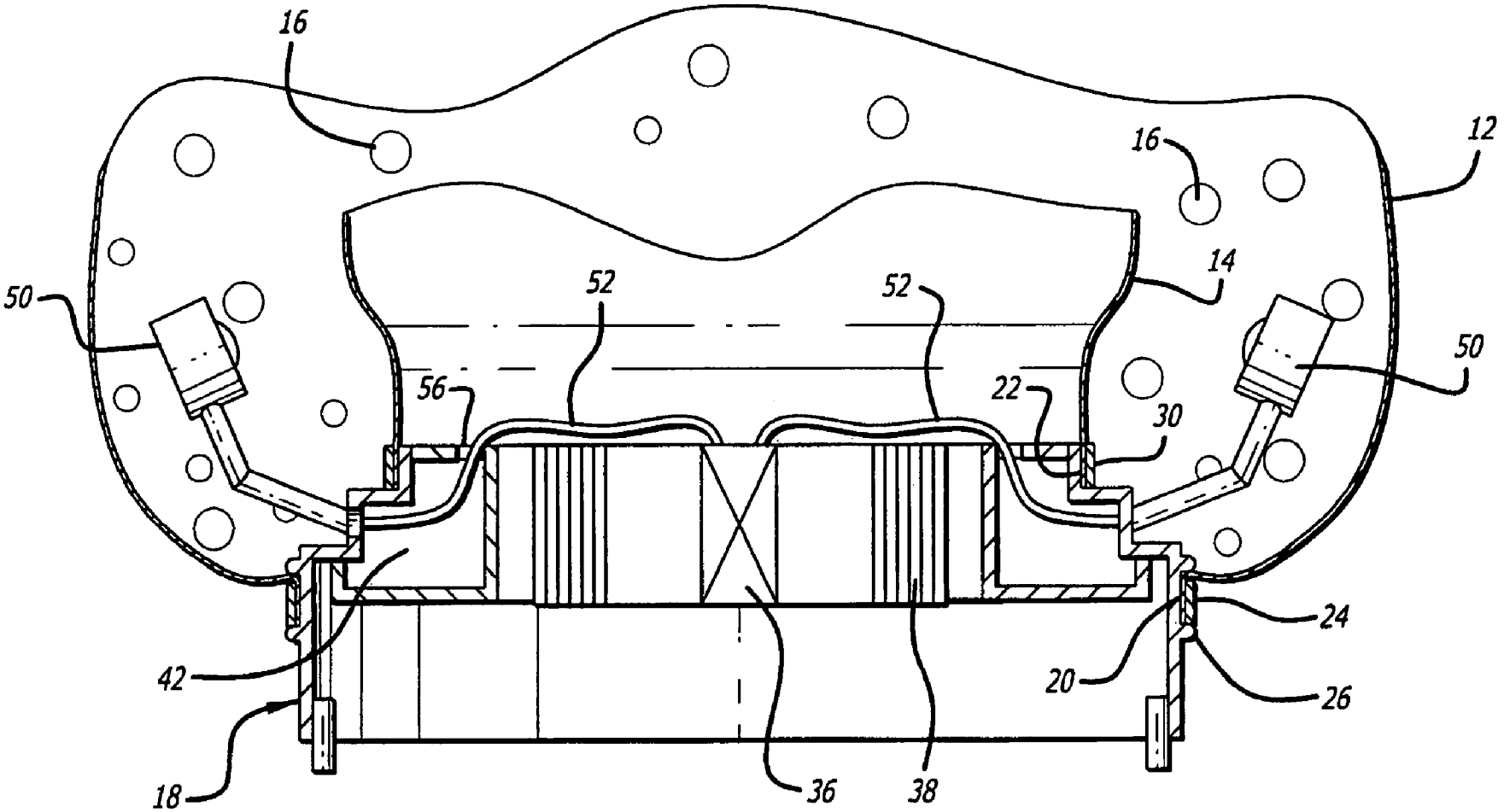
FIG. 6 is an enlarged fragmentary sectional view taken substantially on the line 6-6 in FIG. 2.

The inflatable members 12 and 14 are disposed on a base member generally indicated at 18. The base member 18 has first and second annular surfaces 20 and 22 (FIG. 6). The annular surface 20 is below the annular surface 22 and has a greater radius than the annular surface 22. A belt 24 (FIG. 6) is disposed on the annular surface 20 between a pair of positioning lobes 26. The belt 24 is tightened and retained against the outer inflatable member 12 by a buckle 28 (FIG. 1). In like manner, a belt 30 is disposed on the annular surface 22. The inner inflatable member 14 is disposed between the annular surface 22 and the belt 30. The belt 30 is tightened and retained against the inner inflatable member by a buckle (not shown) similar to the buckle 29.

A motor assembly generally indicated at 34 (FIG. 2) is disposed on the base member 18. The motor assembly 34 includes a motor 36 and a fan 38. The fan 38 is attached to the motor 36 by spacers 40. Manifolds 42 extend from the fan 38 and provide channels for the flow of air under pressure. The base member 18 has a side wall 44 with a cut-out portion 45 which provides for the introduction of air to the fan 38.

Figure 4:
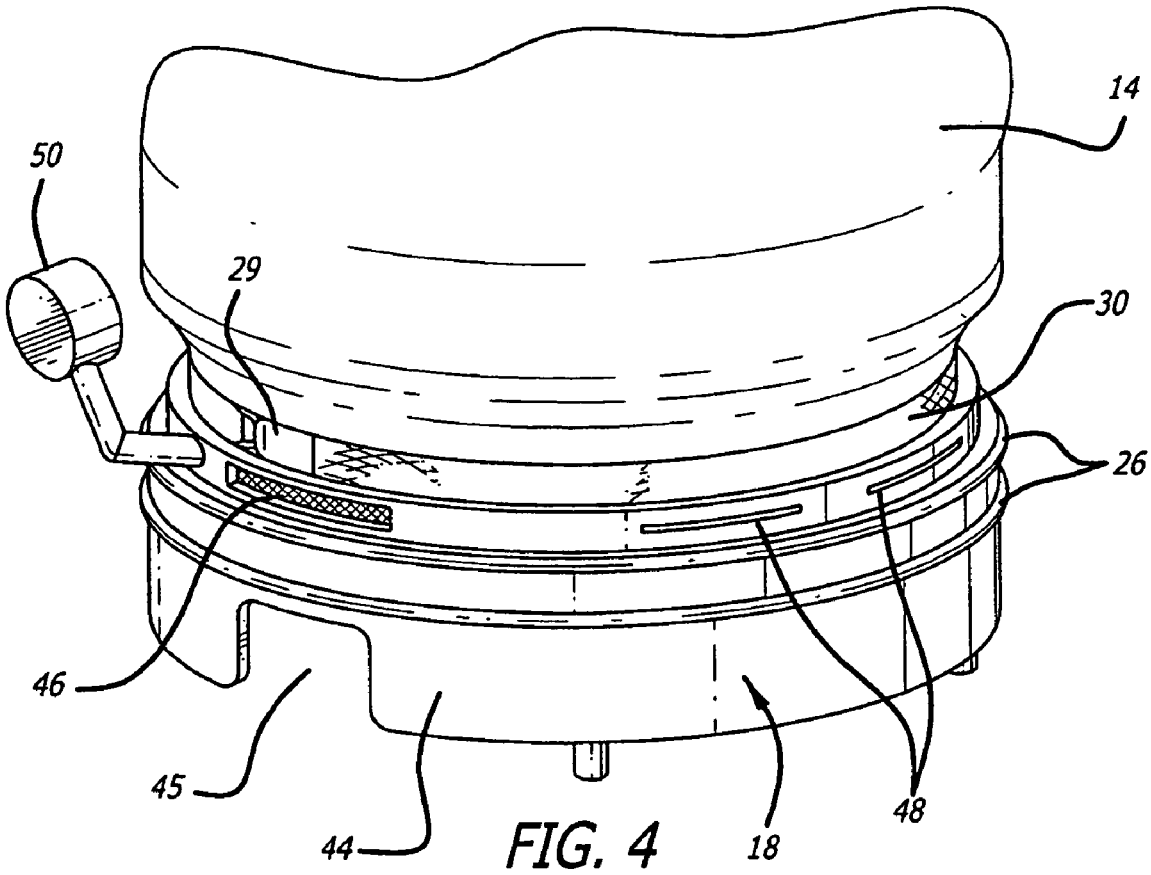
FIG. 4 is an enlarged fragmentary perspective view of the bottom portion of the visual display.

Vents 46 and 48 (FIG. 4) are disposed in the base member 18 to pass air provided under pressure by the fan 38. The vent 46 is larger than the combined openings of the vents 48. The air passing through the vent 46 acts upon the flakes 16 to raise the flakes above the base member 18. The vents 48 act upon the flakes to move the flakes in an annular direction in the space above the base member 18 and between the inflatable members 12 and 14. In this way, the flakes become disposed throughout the space above the base member and between the inflatable members 12 and 14 without falling to the base member.

Light bulbs 50 (FIGS. 4 and 6) are disposed in the space between the inflatable members 12 and 14. Electrical leads 52 communicate with leads 54 from an external source of power (e.g., a wall socket or a battery, neither of which is shown) and provide power to the bulbs 50 and the motor 36. The leads 52 extend through openings 56 in the base member 18. The openings 56 provide for the passage of pressurized air from the fan 38 into the inner inflatable member 14. The pressure imparted by the pressurized air to the interior of the inner inflatable member 14 is the same at each instant as the pressure imparted to the interior of the outer inflatable member 12.

Figure 5:
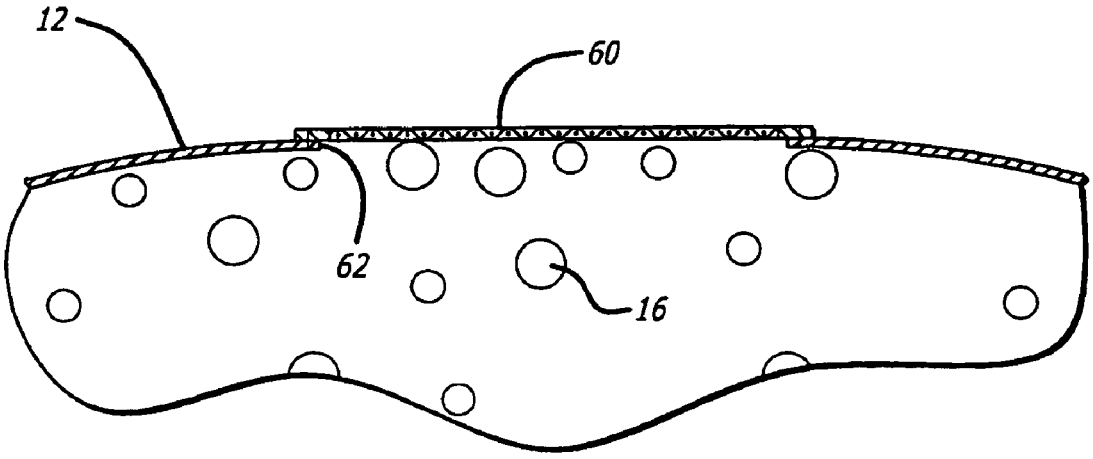
FIG. 5 is an enlarged fragmentary sectional view in elevation of the top portion of the visual display.

A cap 60 (FIGS. 3 and 5) suitably attached to the inflatable member 12 as by an adhesive covers an opening 62 at the top of the outer inflatable member 12. The cap 60 may be made from a permeable material such as a permeable plastic material to limit the pressure in the inflatable members 12 and 14 to a particular value providing for a full inflation, but not an over-inflation, of the inflatable members 12 and 14. The particular pressure of the air in the inflatable members 12 and 14 is not sufficient to cause the flakes 16 to become adhered to the cap 60 or to any portion of the inflatable members 12 and 14. In this way, all of the flakes 16 are able to travel continuously in an annular direction through the space between the inflatable members 12 and 14 when the members are inflated.

Air passes through the opening 45 to the motor assembly 34. When electrical power is introduced to the visual display 10, the air passes under pressure through the vents 46 and 48 to inflate the outer member 12 and through the openings 56 to inflate the inner member 14. The maximum pressure of the air in the outer member 12 and the inner member 14 is limited by the permeable cap 60. The resultant pressure in the outer and inner members 12 and 14 is sufficiently high to fully inflate the members but not so high that the flakes 16 become adhered to the cap 60 or the walls of the inflatable members.

The air pressing under pressure through the vent 46 acts in a direction and with a force to lift the flakes 16 from the base member 18. The air passing under pressure through the vents 48 move the flakes 18 in an annular direction around the visual display 10 in the space between the outer and inner members 12 and 14. In this way, the flakes 16 look and act like snowflakes in a display involving a globe (the outer member 12) and a Christmas tree (the inner member 14).

The visual display 10 thus provides a three-dimensional display of a scene ideally associated with Christmas. It will be appreciated that the visual display 10 is not limited to a Christmas scene. It can be adapted by a person of ordinary skill in the art to represent any religious or national holiday or any noteworthy event in many fields including sports, theatre, etc.

Although this invention has been disclosed and illustrated with reference to particular preferred embodiments, the principles involved are susceptible for use in numerous other embodiments which will be apparent to persons of average skill in the art. The invention is therefore to be limited only as indicated by the scope of the appended claims.

I claim:

1. A visual display comprising:

a base member, an inner inflatable member secured to the base member to define a first enclosure with the base member, an outer inflatable member secured to the base member to define a second enclosure with the base member, the inner inflatable member being disposed within the second enclosure, a motor assembly secured to the base member to generate air under pressure and to introduce the air into the inner and outer inflatable members, and a plurality of flakes disposed within the second enclosure in a space between the outer inflatable member and the inner inflatable member, wherein the base member is constructed to pass the air under pressure into the outer inflatable member and into the inner inflatable member, the outer inflatable member being constructed to limit the pressure of air in the inner and outer inflatable members, and wherein the base member is constructed to pass the air under pressure into the outer inflatable member to move the flakes upwardly, and in an annular direction, in the space between the inner and outer inflatable members.

2. The visual display as set forth in claim 1, wherein the outer inflatable member being constructed to prevent the flakes from sticking to a surface of the outer inflatable member during the movement of the flakes in the space between the inner and outer inflatable members.

3. The visual display as set forth in claim 1, wherein the inner and outer inflatable members being open at their bottom ends and being disposed on the base member to close the openings at their bottom ends for the reception of the air under pressure in the inflatable members, and straps being provided on the base member to retain the inner and outer inflatable members on the base member in uninflated and inflated conditions of the inner and outer inflatable members.

4. The visual display as set forth in claim 1, further comprising:

light bulbs in the space between the inner and outer inflatable members, at least one opening in the base member, the opening providing for the flow of air under pressure into the inner inflatable member, and electrical leads extending through the at least one opening in the base member to the light bulbs for illuminating the light bulbs.

5. The visual display as set forth in claim 1, further comprising:

the outer inflatable member being constructed to prevent the flakes from sticking to a surface of the outer inflatable member during the movement of the flakes in the space between the inner and outer inflatable members, the inner and outer inflatable members being open at their bottom ends and being disposed on the base member to close the openings at their bottom ends for the reception of the air under pressure in the inflatable members, and straps on the base member to retain the inner and outer inflatable members on the base member in uninflated and inflated conditions of the inner and outer inflatable members, light bulbs in the space between the inner and outer inflatable members, at least one opening in the base member, the opening providing for the flow of air under pressure into the inner inflatable member, and electrical leads extending through the at least one opening in the base member to the light bulbs for illuminating the light bulbs.

6. The visual display of claim 1, further comprising:

a first vent in the base member for passing the air under pressure into the outer inflatable member to move the flakes upwardly from the base member in the space between the inner inflatable member and the outer inflatable member, and a second vent in the base member for passing the air under pressure into the outer inflatable member to move the flakes in an annular direction in the space between the inner inflatable member and the outer inflatable member.

7. The visual display of claim 1, further comprising:

a permeable cap disposed on the outer inflatable member for limiting the pressure of the air in the inner and outer inflatable members.

8. The visual display of claim 1, wherein the motor assembly comprises a fan and a motor, wherein the fan is adapted to be driven by the motor to generate a flow of the air under pressure.

* * * * *